US007176611B2

(12) United States Patent
Jung

(10) Patent No.: US 7,176,611 B2
(45) Date of Patent: Feb. 13, 2007

(54) COLOR CATHODE RAY TUBE

(75) Inventor: Sung-Han Jung, Kumi (KR)

(73) Assignee: LG. Philips Displays Korea Co., Ltd., Kyeongsangbuk-Do (KR)

( * ) Notice: Subject to any disclaimer, the term of this patent is extended or adjusted under 35 U.S.C. 154(b) by 198 days.

(21) Appl. No.: 10/763,333

(22) Filed: Jan. 26, 2004

(65) Prior Publication Data

US 2005/0007006 A1 Jan. 13, 2005

(30) Foreign Application Priority Data

Jul. 8, 2003 (KR) ..... 10-2003-0046156

(51) Int. Cl.
*H01J 29/10* (2006.01)
*H01J 29/92* (2006.01)

(52) U.S. Cl. ..... 313/461; 313/477 R

(58) Field of Classification Search ..... 313/461, 313/477 R; 220/2.1 A, 2.1 R
See application file for complete search history.

(56) References Cited

U.S. PATENT DOCUMENTS 4,537,321 A * 8/1985 Tokita ..... 220/2.1 A
4,537,322 A * 8/1985 Okada et al. ..... 220/2.1 A
5,155,410 A * 10/1992 Wakasono et al. ..... 313/402
6,157,124 A * 12/2000 Wakasono ..... 313/461
2003/0122474 A1* 7/2003 Lee ..... 313/477 R
2004/0239232 A1* 12/2004 Baek et al. ..... 313/477 R

OTHER PUBLICATIONS

Wolfram Research MathWorld Natural Logarithm Article:□□http://mathworld.wolfram.com/NaturalLogarithm.html.*

* cited by examiner

*Primary Examiner*—Mariceli Santiago
*Assistant Examiner*—Anne M Hines
(74) *Attorney, Agent, or Firm*—Birch, Stewart, Kolasch & Birch, LLP

(57) ABSTRACT

A color CRT is disclosed to improve a production yield of a panel by reducing a damage due to a thermal impact in a furnace in a thermal treatment process in fabricating the panel and accomplish a light-weight product and a cost reduction compared to the same type CRT, for which a following condition is satisfied: $-1.7168*Ln(U)+11.627 \leqq (Rh*Rv*Ro/U)*Tc \leqq -2.0131*Ln(U)+13.645$, where U is a diagonal size of an effective surface of the panel, Rh, Rv and Ro are parameters determined based on dimensions of the panel, and Tc is the thickness of the panel at its center point.

11 Claims, 9 Drawing Sheets

COLOR CATHODE RAY TUBE

This Non-provisional application claims priority under 35 U.S.C. § 119(a) on Patent Application No. 10-2003-0046156 filed in KOREA on Jul. 8, 2003, the entire contents of which are hereby incorporated by reference.

BACKGROUND OF THE INVENTION

1. Field of the Invention

The present invention relates to a color cathode ray tube (CRT) and, more particularly, to a color cathode ray tube capable of reducing a damage rate of a panel due to a thermal impact in a furnace during a thermal treatment of a fabrication process, reducing a weight and enhancing a productivity.

2. Description of the Background Art

In general, a color CRT, a device for displaying images, is divided into two types of CRT: a curved-surface CRT and a flat CRT depending on an outer shape of a panel.

The curved-surface CRT having a curved outer surface is decreasing in its demand due to problems such as an image distortion and an eye fatigue due to a light reflection, while the flat CRT (FCD) is increasing in its demand thanks to its advantages that an image is not distorted, reflection by an external light is minimized and a visible region is maximized.

FIG. 1 is a side view showing the interior of the conventional color CRT.

As shown in FIG. 1, the conventional color CRT 10 includes a panel 1 having an effective surface coated with a fluorescent material 1*a*; a mask 2 having a color sorting function for electron beams made incident to the inner side of the panel 1; a funnel 3 coupled to a rear side of the panel 1 and maintaining the interior of the CRT in a vacuum state; a deflection yoke 5 for deflecting electron beams discharged from an electron gun 4; and a reinforcing band 6 engaged at a skirt portion 1*b* of the panel 1.

In the conventional color CRT constructed as described above, when an image signal is inputted to the electron gun 4, the electron gun 4 discharges electron beams, and the thusly discharged electron beams are accelerated and focused toward a fluorescent film 1*a* of the panel by virtue of a voltage applied from each electrode of the electron gun 4.

As the electron beams are deflected by the deflection yoke 5 and pass through a slot formed at the mask 2, a color sorting is made, and then, when the electron beams collide with the fluorescent material 1*a* of the inner surface of the panel 1, each fluorescent material is radiated to reproduce an image.

Since the interior of the color CRT is in the vacuum state by the panel and the funnel, the CRT receives a compression stress or a tensile stress at its the outer side and inner side. And in this case, if an excessive tensile stress is applied to a specific portion of a screen of the panel, a firecracker occurs to cause a big problem of a security.

Referring to the plane surface panel (FCD), its self-strength is weak, a shape of the panel is abnormal compared to a general panel, and a difference of thickness at a central portion and a corner portion is so big that it is disadvantageous for a heat distortion stress structure over a thermal expansion and explosion-proof characteristics, and thus its structural strength is degraded compared to the general curved-surface panel.

Therefore, in case of the conventional plane CRT, since its outer surface is almost flat while its inner surface is formed with a predetermined curvature, the thickness at the corner portion becomes thick to add the weight by as much as about 20%~35% compared to the existing panel, and in manufacturing the panel, a tensile stress at a fused portion is increased due to a thermal impact in the furnace, causing a problem that the panel is increasingly damaged and a production yield of the panel is deteriorated.

SUMMARY OF THE INVENTION

Therefore, an object of the present invention is to provide a color CRT capable of improving a production yield of a panel by reducing a damage due to a thermal impact in a furnace in a thermal treatment process in fabricating the panel and accomplishing a light-weight product and a cost reduction compared to the same type CRT.

To achieve the above object, there is also provided a color CRT in accordance with a fourth embodiment of the present invention having a panel of which outer surface is substantially flat and inner surface has a predetermined curvature and a funnel coupled to a rear side of the panel, in which the center transmittance of an effective surface of the panel is 45%~75%, a diagonal size of the effective surface is 650 mm~700 mm, and a following condition is satisfied: $-17.746*Ln(U)+116.49 \leqq (Rh*Rv*Ro)/U)*Tc \leqq -20.322*Ln(U)+133.45$.

To achieve the above object, there is also provided a color CRT in accordance with a second embodiment of the present invention having a panel of which outer surface is substantially flat and inner surface has a predetermined curvature and a funnel coupled to a rear side of the panel, in which an aspect ratio of an effective surface of the panel is 16:9, a diagonal size of the effective surface is 650 mm~760 mm, and a following condition is satisfied: $-2.1319*Ln(U)+14.589 \leqq (Rh*Rv*Ro)/U)*Tc \leqq -2.5462*Ln(U)+17.414$.

To achieve the above object, there is also provided a color CRT in accordance with a third embodiment of the present invention having a panel of which outer surface is substantially flat and inner surface has a predetermined curvature and a funnel coupled to a rear side of the panel, in which an aspect ratio of an effective surface (U) of the panel is 4:3, a diagonal size of the effective surface is 400 mm~500 mm, and a following condition is satisfied: $-0.8629*Ln(U)+5.6754 \leqq (Rh*Rv*Ro)/U*Tc \leqq -1.0547*Ln(U)+6.9366$.

To achieve the above object, there is also provided a color CRT in accordance with a fourth embodiment of the present invention having a panel of which outer surface is substantially flat and inner surface has a predetermined curvature and a funnel coupled to a rear side of the panel, in which the center transmittance of an effective surface (U) of the panel is 45%~75%, a diagonal size of the effective surface is 650 mm~700 mm, and a following condition is satisfied: $-17.746*Ln(U)+116.49 \leqq (Rh*Rv*Ro)/U)*Tc \leqq -20.322*Ln(U)+133.45$.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Figure 1:
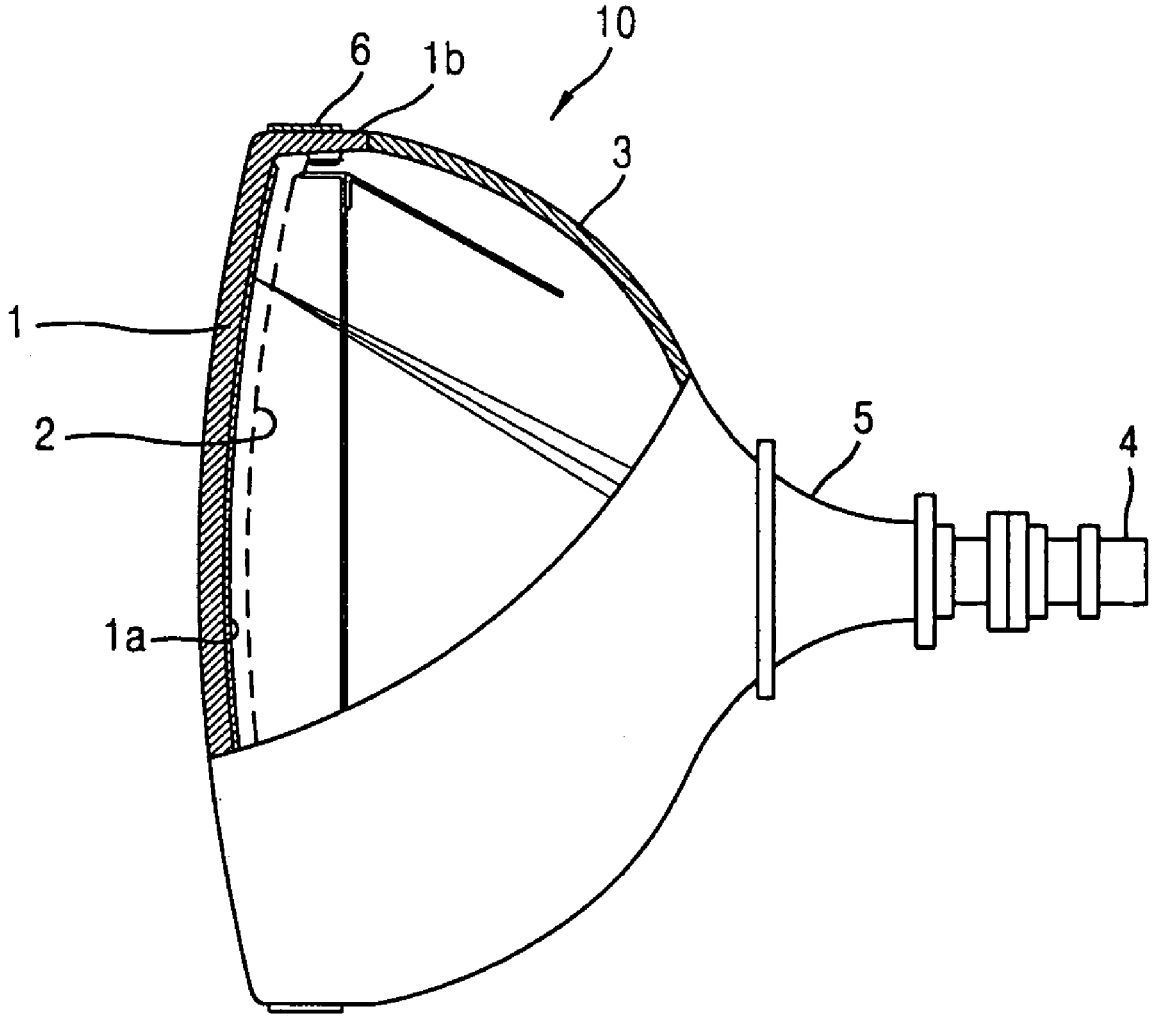
FIG. 1 RELATED ART
FIG. 1 is a vertical-sectional view showing a color CRT in accordance with a conventional art.
Figure 2:
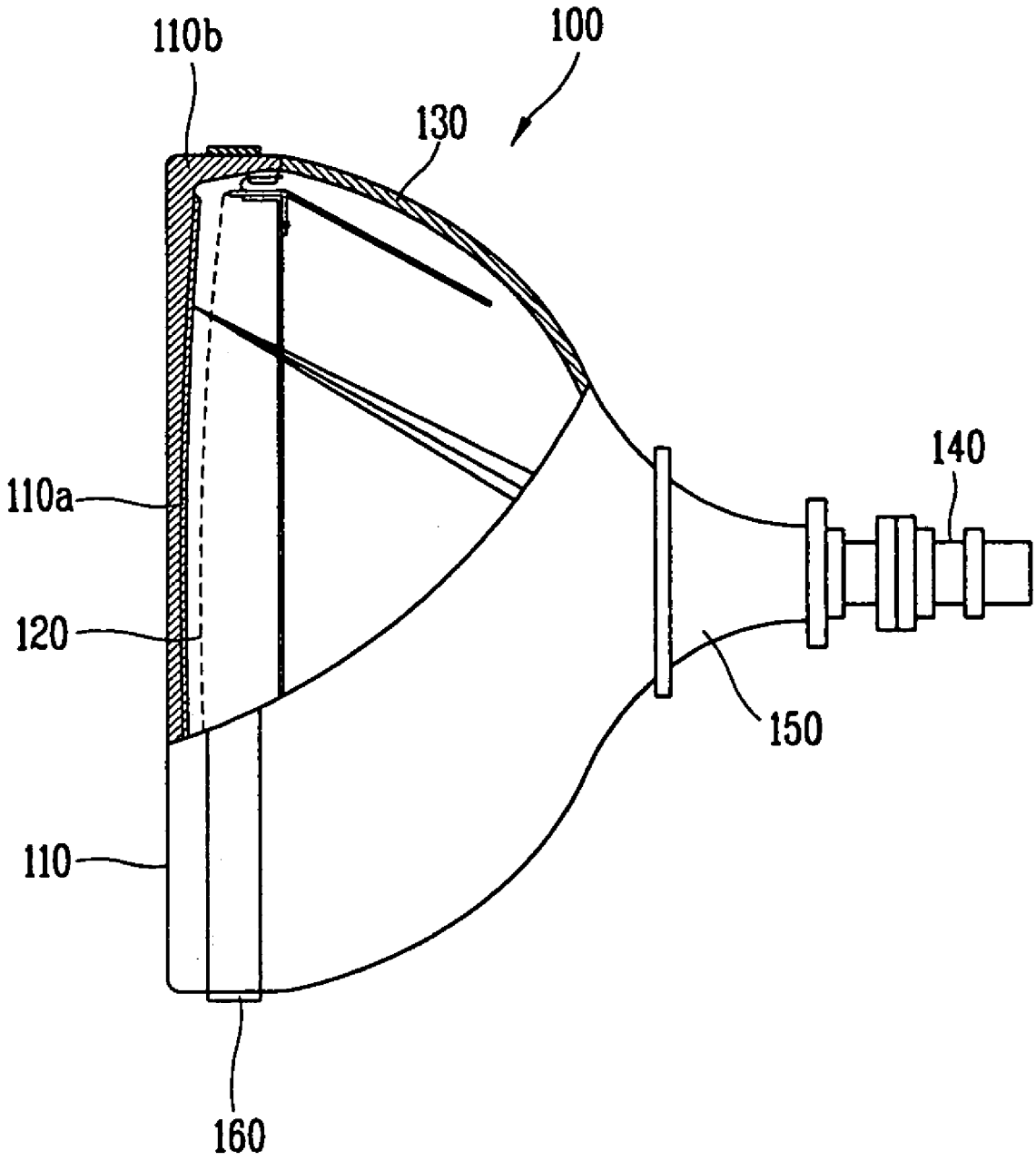
FIG. 2 is a vertical-sectional view showing a color CRT in accordance with the present invention.

Reference will now be made in detail to the preferred embodiments of the present invention, examples of which are illustrated in the accompanying drawings.

A color CRT of the present invention includes a panel 110 having an effective surface; a mask 120 having a color sorting function for electron beams made incident to a fluorescent film 110*a* of the panel 110; a funnel 130 coupled to a rear surface of the panel 110; a deflection yoke 150 for deflecting electron beams discharged from the electron gun 140; and a reinforcing band 160 engaged with a skirt portion 110*b* of the panel.

Figure 3:
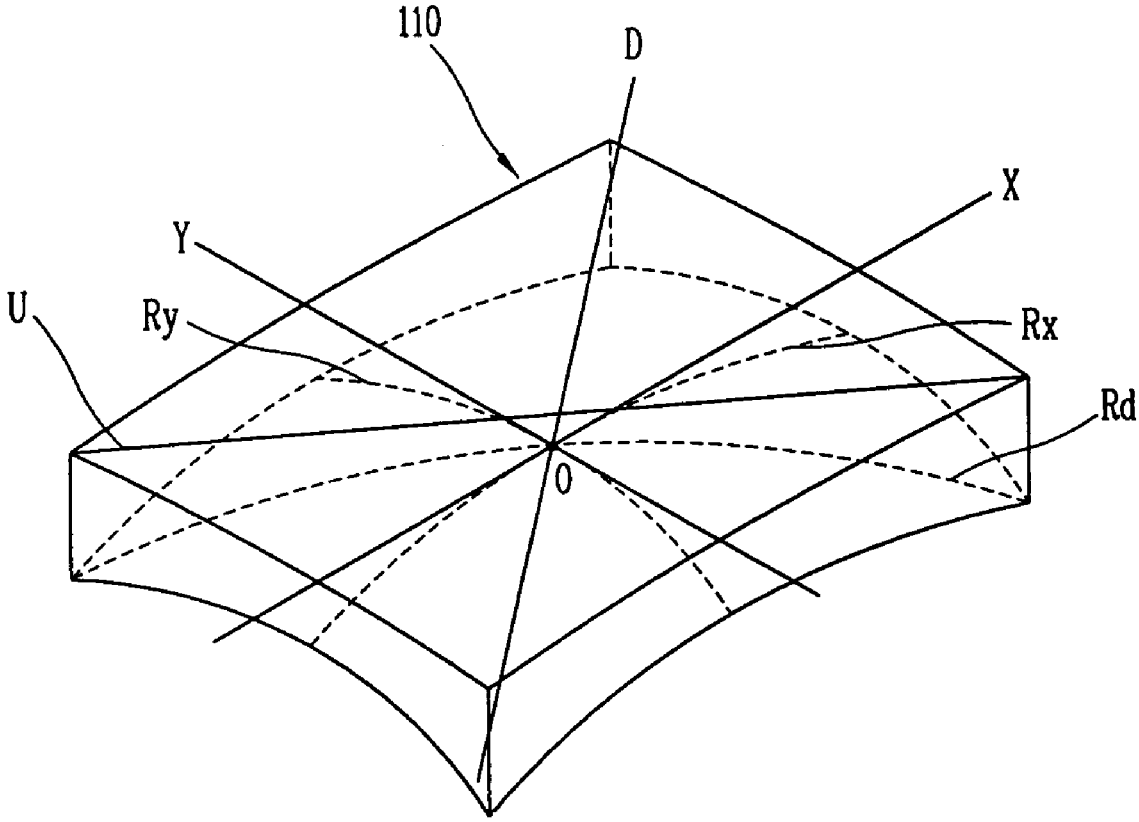
FIG. 3 is a perspective view showing an effective surface of a panel of the color CRT in accordance with the present invention.
Figure 4A:
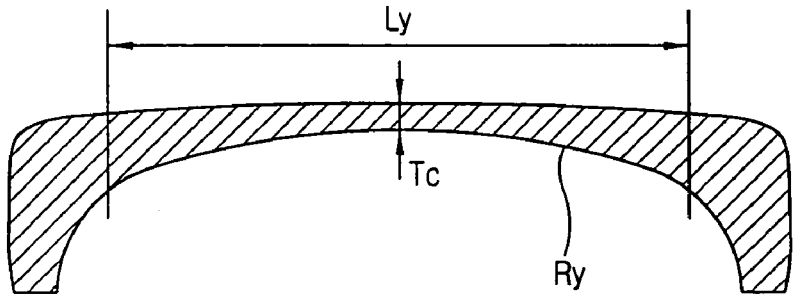
FIG. 4A is a vertical-sectional view showing a radius of a curvature of an inner surface of the panel following a short axis (Y)
Figure 4B:
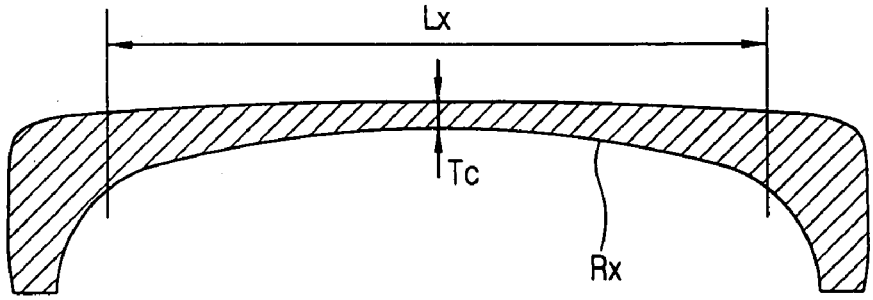
FIG. 4B is a vertical-sectional view showing a radius of a curvature of an inner surface of the panel following a long axis (X)
Figure 4C:
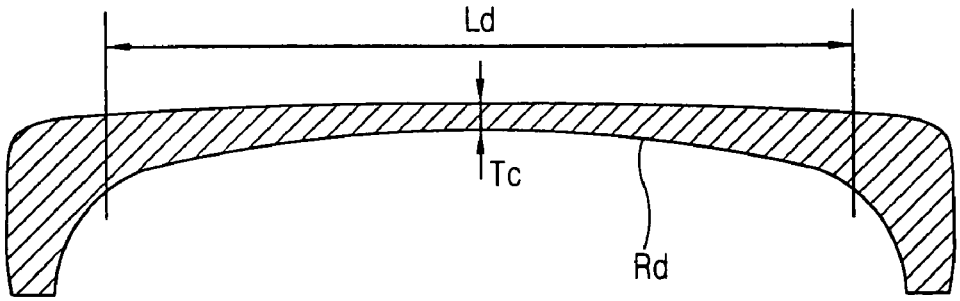
FIG. 4C is a vertical-sectional view showing a radius of a curvature of an inner surface of the panel following a diagonal axis (D)
Figure 5:
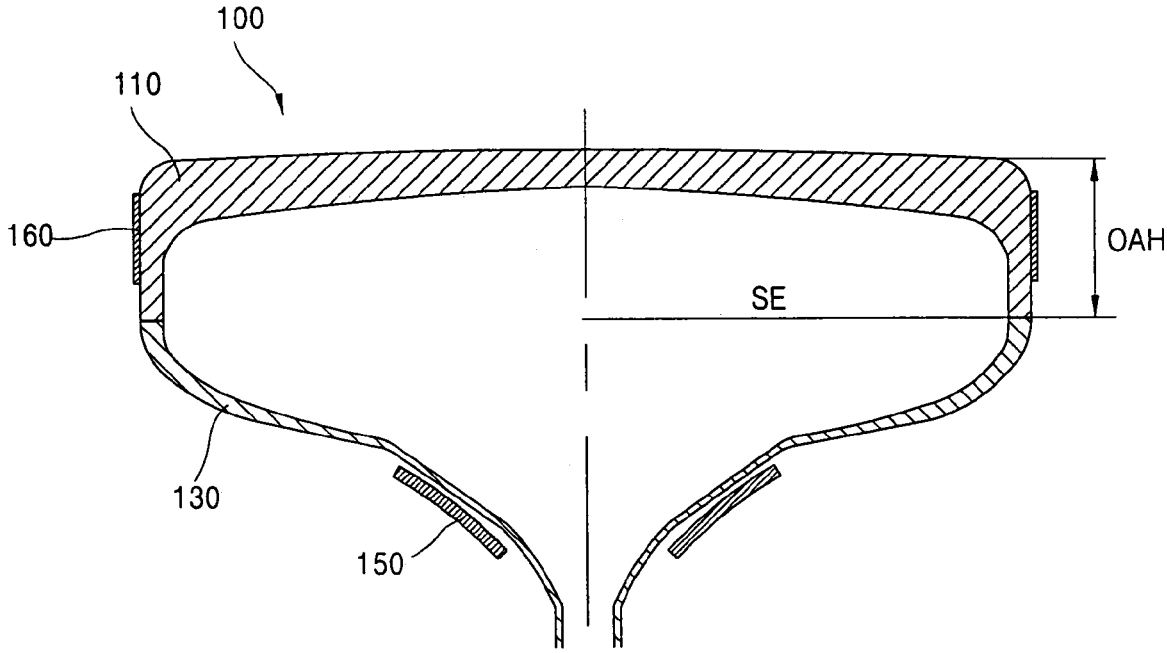
FIG. 5 is a view explaining an OAH of the panel.

FIG. 3 is a perspective view showing an effective surface of a panel of the color CRT in accordance with the present invention, FIG. 4A is a vertical-sectional view showing a curvature radius of an inner surface of the panel following a short axis (Y), FIG. 4B is a vertical-sectional view showing a curvature radius of an inner surface of the panel following a long axis (X), FIG. 4C is a vertical-sectional view showing a curvature radius of an inner surface of the panel following a diagonal axis (D), and FIG. 5 is a view explaining an OAH of the panel.

As shown in these drawings, it is assumed that a value obtained by dividing an inner curvature radius Rx of the effective surface of the panel following a long axis (X) by a distance Lx of the effective surface of the panel following a 1.767*long axis is Rh, a value obtained by dividing an inner curvature radius Ry of the effective surface of the panel following a short axis (Y) by a distance Ly of the effective surface following a 1.767*short axis is Rv, a value obtained by dividing an inner curvature radius of the effective surface of the panel following a diagonal axis (D) by a distance Ld of the effective surface following 1.767*diagonal axis is Ro, and the thickness of the center point of the panel 100 is Tc.

The color CRT of the present invention is directed to improve a structure of the panel in order to accomplish a light weight while having a compatibility with respect to the existing CRT without re-designing a mask, a frame, a band or the deflection yoke.

Figure 6:
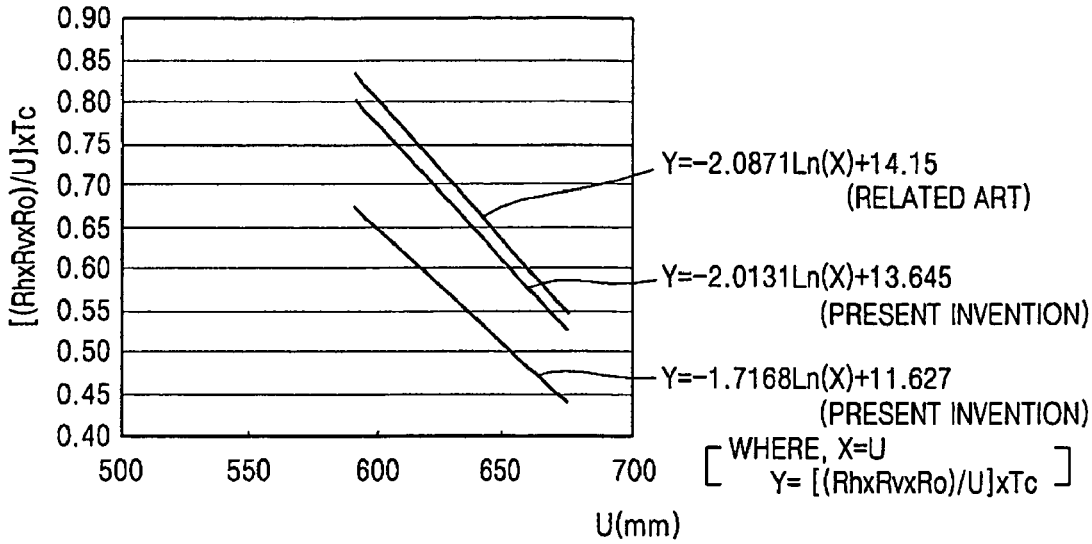
FIG. 6 is a graph showing (Rh*Rv*Ro/U)*Tc according to a diagonal size (U) of an effective surface of the panel of which an aspect ratio of the effective surface is 4:3, a diagonal size (U) of the effective surface is 570 mm~700 mm in a color CRT in accordance with a first embodiment of the present invention.
Figure 7:
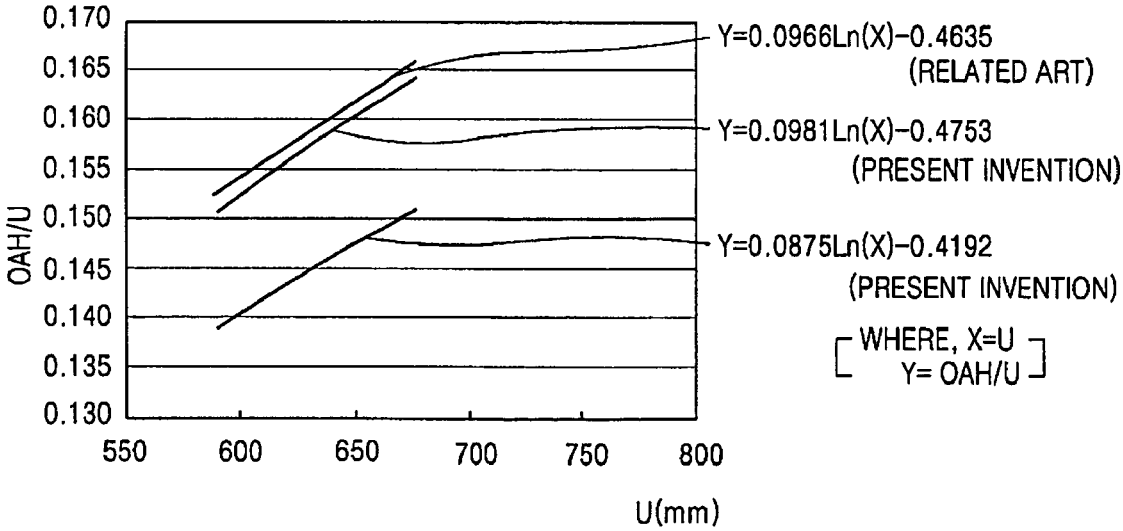
FIG. 7 is a graph showing OAH/U according to the diagonal size (U) of the effective surface of the panel.

FIG. 6 is a graph showing (Rh*Rv*Ro/U)*Tc according to a diagonal size (U) of an effective surface of the panel of which an aspect ratio of the effective surface is 4:3, a diagonal size (U) of the effective surface is 570 mm~700 mm in a color CRT in accordance with a first embodiment of the present invention, and FIG. 7 is a graph showing OAH/U according to the diagonal size (U) of the effective surface of the panel.

As shown in FIG. 6, a color CRT in accordance with the first embodiment of the present invention is constructed such that an aspect ratio of the effective surface of the panel is 4:3, a diagonal size (U) of the effective surface is 570 mm~700 mm, and a following condition is satisfied: $-1.7168*Ln(U)+11.627 \leqq (Rh*Rv*Ro/U)*Tc \leqq -2.0131*Ln(U)+13.645$, wherein Tc is set to be $10\ mm \leqq Tc \leqq 12.4\ mm$.

In this respect, (Rh*Rv*Ro) needs to be considered according to Tc because Rh, Rv, Ro and Tc are closely related to a flat surface image effect, a structural strength enduring an atmospheric pressure against a high vacuum inside the CRT, shaping characteristics of the panel, a damage rate in a heat treatment in fabricating the CRT, and a reproduction yield.

The reason why the range of (Rh*Rv*Ro/U)*Tc is the same or greater than $-1.7168*Ln(U)+11.627$ but the same or smaller than $-2.0131*Ln(U)+13.645$ is as follows.

First, if (Rh*Rv*Ro/U)*Tc is smaller than $-1.7168*Ln(U)+11.627$, (Rh*Rv*Ro/U) or Tc should be reduced.

If (Rh*Rv*Ro/U) is small, it means that the curvature of the panel is sharply increased as it goes from the central portion to an edge. In this case, a wedge rate, a thickness ratio between the central portion and the corner portion of the panel, is increased. Then, a thermal stress distribution is severely distorted only to increase a damage rate of the panel in the furnace which the panel is to undergo necessarily during its fabrication and the CRT fabrication and degrade a reproduction yield.

In addition, since a distortion amount of a screen image is sharply increased, an flat surface image effect of the screen is deteriorated and a B/U signifying a brightness uniformity of the edge portion is degraded, making it impossible to reproduce a suitable image.

If TC is reduced, it may be advantageous in terms of light weight but the strength of the panel itself is much deteriorated and a problem may arise with respect to an X-Ray and an explosion-proof characteristics defined by a security institute for satisfying a security of consumers.

Meanwhile, if (Rh*Rv*Ro/U)*Tc is greater than −2.0131*Ln(U)+13.645, (Rh*Rv*Ro/U) or Tc should be increased.

If (Rh*Rv*Ro/U) is increased, it means that the curvature of the panel is reduced as it goes from the central portion to the edge so the panel itself is flattened. In this case, the wedge rate, the thickness ratio between the central portion and the corner portion is reduced.

With the curvature of the panel diminished as it goes from the central portion of the panel to the edge and the reduced wedge rate, a strength of the panel weakens to cause a problem of the explosion-proof characteristics, and in addition, since the mask corresponding to the panel flattens accordingly, its strength also weakens. Degradation of the strength causes a degradation of a screen color purity due to Doming, and then, Hauling characteristics and drop characteristics are also degraded.

Increase of Tc can be advantageous for the X-Ray and explosion-proof characteristics as it reinforces the strength of the panel. In this case, however, the overall weight of the panel is increased only to increase a panel damage in the furnace which the CRT passes through necessarily in its fabrication, and as the central portion of the panel becomes thick, luminance characteristics, the brightness of the central portion, are too degraded to reproduce a suitable image. In addition, the increase in the weight of the panel causes a problem of a productivity and a cost increase.

In order to solve such problems, the color CRT in accordance with a first embodiment of the present invention is designed to satisfy the following condition: −1.7168*Ln(U)+11.627≦(Rh*Rv*Ro/U)*Tc≦−2.0131*Ln(U)+13.645.

In addition, the color CRT in accordance with a first embodiment of the present invention is designed to satisfy the following condition: 0.0875*Ln(U)−0.4192≦OAH/U≦0.0981*Ln(U)−0.4753.

If OAH/U is the same or greater than 0.0981*Ln(U)−0.4753, a light-weight panel according to OAH of the panel can not be accomplished, and thus, the production yield of the panel and cost reduction can not be also accomplished.

In addition, since the panel damage is increased due to difference in a heat transfer rate according to OAH of the panel in the furnace, a reproduction yield is degraded.

Meanwhile, if OAH/U is the same or smaller than 0.0875*Ln(U)−0.4192, characteristics should be necessarily obtained through re-designing due to increase in power consumption and picture quality degradation according to an optical angle deflection. In addition, since OAH is too short for compatibility of internal components, all the components should be newly designed, resulting in increase of an expense for its process and component designing.

As afore-mentioned, the color CRT in accordance with the first embodiment of the present invention satisfies the following condition: 0.0875*Ln(U)−0.4192≦OAH/U≦0.0981*Ln(U)−0.4753.

As stated above, because the color CRT in accordance with the first embodiment of the present invention satisfies the following conditions of FIGS. 6 and 7 of −1.7168*Ln(U)≦11.627≦(Rh*Rv*Ro/U)*Tc≦−2.0131*Ln(U)+13.645 and 0.0875*Ln(U)−0.4192≦OAH/U≦0.0981*Ln(U)−0.4753, the weight of the panel is reduced, a load in the furnace during the fabrication process of the CRT is reduced, and a light weight and a unit cost reduction are accomplished compared to the same type of CRT. Accordingly, its productivity is improved.

Figure 8:
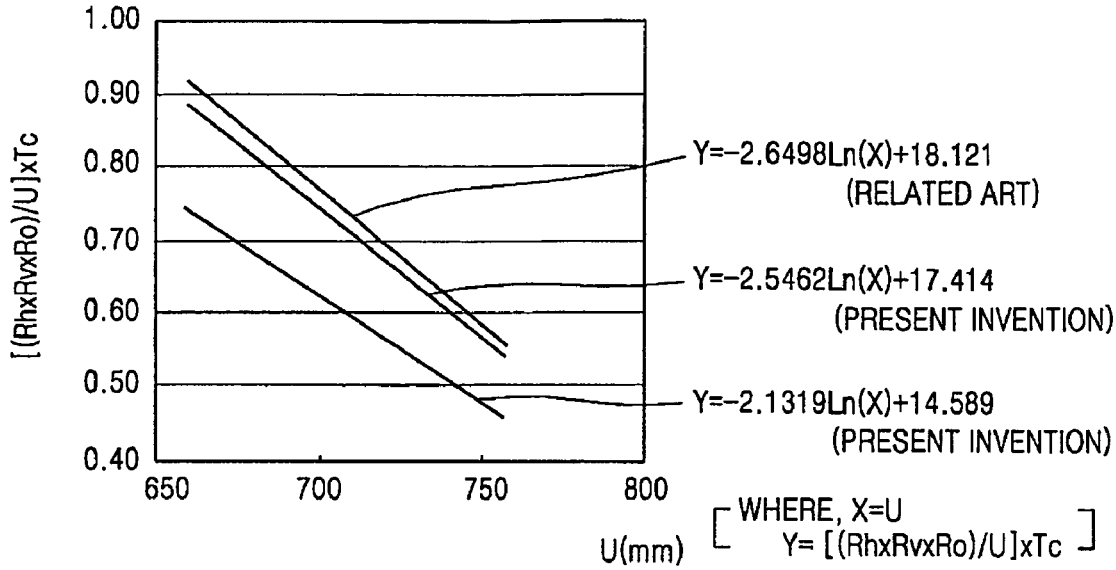
FIG. 8 is graph showing (Rh*Rv*Ro/U)*Tc according to a diagonal size (U) of an effective surface of the panel of which an aspect ratio of the effective surface is 16:9, a diagonal size (U) of the effective surface is 650 mm~760 mm in a color CRT in accordance with a second embodiment of the present invention.
Figure 9:
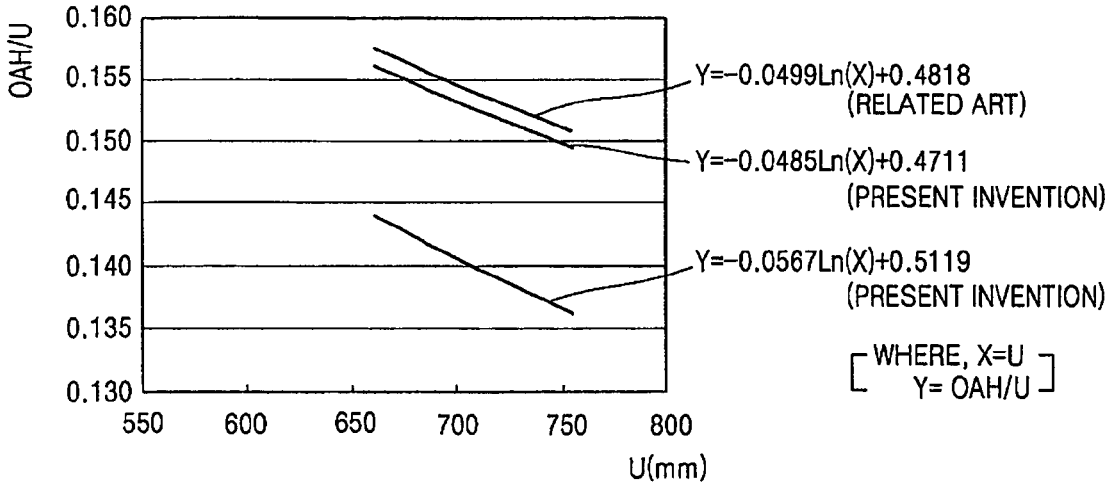
FIG. 9 is a graph showing OAH/U according to the diagonal size (U) of the effective surface of the panel.

FIG. 8 is graph showing (Rh*Rv*Ro/U)*Tc according to a diagonal size (U) of an effective surface of the panel of which an aspect ratio of the effective surface is 16:9, a diagonal size (U) of the effective surface is 650 mm~760 mm in a color CRT in accordance with a second embodiment of the present invention, and FIG. 9 is a graph showing OAH/U according to the diagonal size (U) of the effective surface of the panel.

As shown in FIG. 8, a color CRT in accordance with the second embodiment of the present invention is constructed such that when an aspect ratio of the effective surface of the panel is 16:9 and a diagonal size (U) of the effective surface is 650 mm~760 mm, a following condition is satisfied: −2.1319*Ln(U)+14.589≦(Rh*Rv*Ro/U)*Tc≦−2.5462*Ln(U)+17.414, wherein Tc is set to be 11 mm≦Tc≦13.4 mm.

In addition, the color CRT in accordance with the second embodiment of the present invention also satisfies −0.0567*Ln(U)+0.5119≦OAH/U≦−0.0485*Ln(U)+0.4711, as shown in FIG 9.

As stated above, because the color CRT in accordance with the second embodiment of the present invention satisfies the following conditions of FIGS. 8 and 9 of −2.1319*Ln(U)+14.589≦(Rh*Rv*Ro/U)*Tc≦−2.5462*Ln(U)+17.414 and −0.0567*Ln(U)+0.5119≦OAH/U≦−0.0485*Ln(U)+0.4711, the weight of the panel is reduced, a load in the furnace during the fabrication process of the CRT is reduced, and a light weight and a unit cost reduction are accomplished compared to the same type of CRT. Accordingly, its productivity is improved.

Figure 10:
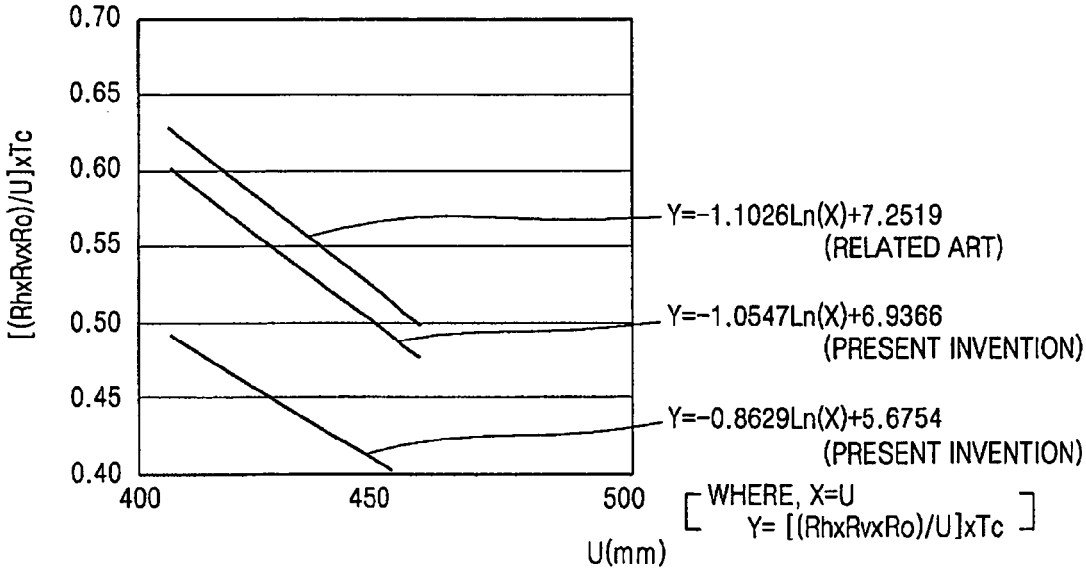
FIG. 10 is graph showing (Rh*Rv*Ro/U)*Tc according to a diagonal size (U) of an effective surface of the panel of which an aspect ratio of the effective surface is 4:3, a diagonal size (U) of the effective surface is 400 mm~500 mm in a color CRT in accordance with a third embodiment of the present invention.
Figure 11:
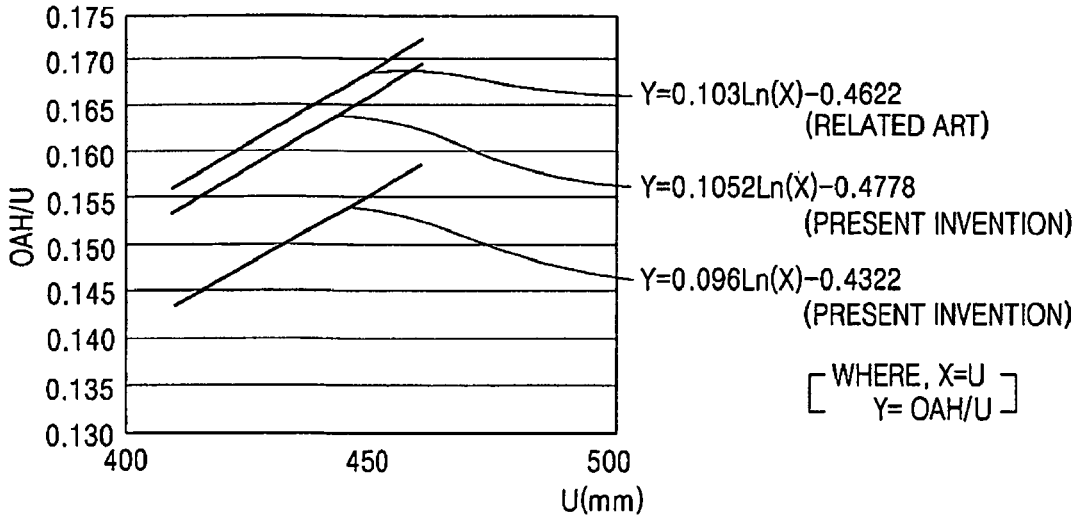
FIG. 11 is a graph showing OAH/U according to the diagonal size (U) of the effective surface of the panel.

FIG. 10 is graph showing (Rh*Rv*Ro/U)*Tc according to a diagonal size (U) of an effective surface of the panel of which an aspect ratio of the effective surface is 4:3, a diagonal size (U) of the effective surface is 400 mm~500 mm in a color CRT in accordance with a third embodiment of the present invention, and FIG. 11 is a graph showing OAH/U according to the diagonal size (U) of the effective surface of the panel.

As shown in FIG. 10, a color CRT in accordance with the third embodiment of the present invention is constructed such that when an aspect ratio of the effective surface of the panel is 4:3 and a diagonal size (U) of the effective surface is 400 mm~500 mm, a following condition is satisfied: −0.8629*Ln(U)+5.6754≦(Rh*Rv*Ro)/U*Tc≦−1.0547*Ln(U)+6.9366, wherein Tc is set to be 9 mm≦Tc≦11.5 mm.

In addition, the color CRT in accordance with the third embodiment of the present invention also satisfies 0.096*Ln(U)−0.4322≦OAH/U≦0.1052*Ln(U)−0.4778., as shown in FIG. 11.

As stated above, because the color CRT in accordance with the third embodiment of the present invention satisfies the following conditions of 0.8629*Ln(U)+5.6754≦(Rh*Rv*Ro)/U*Tc≦−1.0547*Ln(U)+6.9366 and, 0.096*Ln(U)−0.4322≦OAH/U≦0.1052*Ln(U)−0.4778, the weight of the panel is reduced, a load in the furnace during the fabrication process of the CRT is reduced, and a light weight and a unit cost reduction are accomplished compared to the same type of CRT. Accordingly, its productivity is improved.

Figure 12:
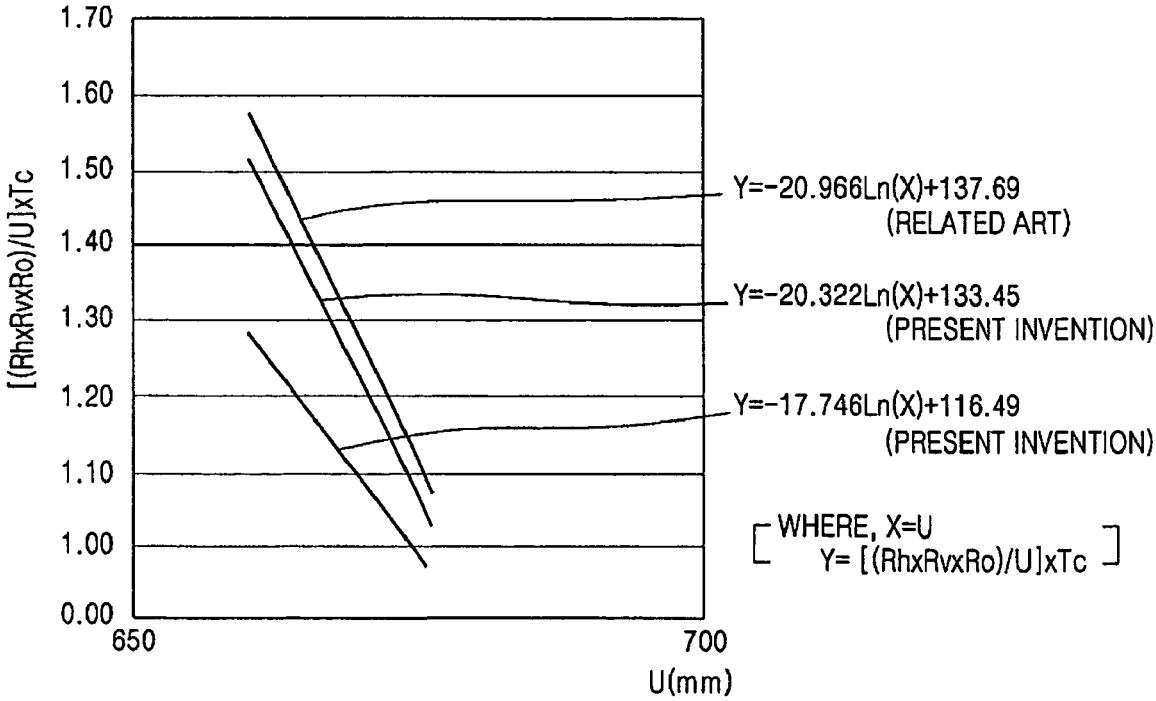
FIG. 12 is graph showing (Rh*Rv*Ro/U)*Tc according to a diagonal size (U) of an effective surface of the panel (tint panel) of which a diagonal size (U) of the effective surface is 650 mm~700 mm in a color CRT in accordance with a fourth embodiment of the present invention.

FIG. 12 is graph showing (Rh*Rv*Ro/U)*Tc according to a diagonal size (U) of an effective surface of the panel of which a diagonal size (U) of the effective surface is 650 mm~700 mm and tint in a color CRT in accordance with a fourth embodiment of the present invention.

As shown in FIG. 12, a color CRT in accordance with the fourth embodiment of the present invention is constructed such that when the center transmission of the panel is 45%~75% and the diagonal size (U) of the effective surface of the panel is 650~700 mm, a following condition is satisfied: $-17.746*Ln(U)+116.49 \leqq (Rh*Rv*Ro)/U*Tc \leqq -20.322*Ln(U)+133.45$, wherein Tc is set to be 10 mm≦Tc≦13.4 mm, and the thickness at the edge portion of the panel is equal to or smaller than 25 mm.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A color CRT having a panel of which outer surface is substantially flat and inner surface has a predetermined curvature and a funnel coupled to a rear side of the panel, wherein an aspect ratio of an effective surface of the panel is 4:3, a diagonal size (U) of the effective surface is 570 mm~700 mm, and a following condition is satisfied:

$$-1.7168*Ln(U/1\text{ mm})+11.627 \leqq (Rh*Rv*Ro/U)*Tc \leqq -2.0131*Ln(U/1\text{ mm})+13.645,$$

wherein a value obtained by dividing an inner curvature radius Rx of the effective surface of the panel following a long axis (X) by a distance Lx of the effective surface of the panel following a 1.767*long axis is Rh, a value obtained by dividing an inner curvature radius Ry of the effective surface of the panel following a short axis (Y) by a distance Ly of the effective surface following a 1.767*short axis is Rv, a value obtained by dividing an inner curvature radius of the effective surface of the panel following a diagonal axis (D) by a distance Ld of the effective surface following 1.767*diagonal axis is Ro, and the thickness of the center point of the panel is Tc;

wherein a following condition is satisfied: 10 mm≦Tc≦12.4 mm.

2. A color CRT having a panel of which outer surface is substantially flat and inner surface has a predetermined curvature and a funnel coupled to a rear side of the panel, wherein an aspect ratio of an effective surface of the panel is 4:3, a diagonal size (U) of the effective surface is 570 mm~700 mm, and a following condition is satisfied:

$$-1.7168*Ln(U/1\text{ mm})+11.627 \leqq (Rh*Rv*Ro/U)*Tc \leqq -2.0131*Ln(U/1\text{ mm})+13.645,$$

wherein a value obtained by dividing an inner curvature radius Rx of the effective surface of the panel following a long axis (X) by a distance Lx of the effective surface of the panel following a 1.767*long axis is Rh, a value obtained by dividing an inner curvature radius Ry of the effective surface of the panel following a short axis (Y) by a distance Ly of the effective surface following a 1.767*short axis is Rv, a value obtained by dividing an inner curvature radius of the effective surface of the panel following a diagonal axis (D) by a distance Ld of the effective surface following 1.767*diagonal axis is Ro, and the thickness of the center point of the panel is Tc;

wherein a following condition is satisfied: $0.0875*Ln(U/1\text{ mm})-0.4192 \leqq OAH/U \leqq 0.0981*Ln(U/1\text{ mm})-0.4753$, and a tube axis directional distance from the center of the outer surface of the panel to a seal edge line is OAH.

3. A color CRT having a panel of which outer surface is substantially flat and inner surface has a predetermined curvature and a funnel coupled to a rear side of the panel, wherein an aspect ratio of an effective surface of the panel is 16:9, a diagonal size (U) of the effective surface is 650 mm~760 mm, a following condition is satisfied: $-2.1319*Ln(U/1\text{ mm})+14.589 \leqq (Rh*Rv*Ro)/U)*Tc \leqq -2.5462*Ln(U/1\text{ mm})+17.414$, wherein a value obtained by dividing an inner curvature radius Rx of the effective surface of the panel following a long axis (X) by a distance Lx of the effective surface of the panel following a 1.767*long axis is Rh, a value obtained by dividing an inner curvature radius Ry of the effective surface of the panel following a short axis (Y) by a distance Ly of the effective surface following a 1.767*short axis is Rv, a value obtained by dividing an inner curvature radius of the effective surface of the panel following a diagonal axis (D) by a distance Ld of the effective surface following 1.767*diagonal axis is Ro, and the thickness of the center point of the panel is Tc.

4. The CRT of claim 3, wherein a following condition is satisfied: 11 mm≦Tc≦13.4 mm.

5. The CRT of claim 3, wherein a following condition is satisfied: $-0.0567*Ln(U/1\text{ mm})+0.5119 \leqq OAH/U \leqq -0.0485*Ln(U/1\text{ mm})+0.4711$, and a tube axis directional distance from the center of the outer surface of the panel to a seal edge line is OAH.

6. A color CRT having a panel of which outer surface is substantially flat and inner surface has a predetermined curvature and a funnel coupled to a rear side of the panel, wherein an aspect ratio of an effective surface of the panel is 4:3, a diagonal size (U) of the effective surface is 400 mm~500 mm, and a following condition is satisfied:

$$-0.8629*Ln(U/1\text{ mm})+5.6754 \leqq (Rh*Rv*Ro)/U*Tc \leqq -1.0547*Ln(U/1\text{ mm})+6.9366,$$

wherein a value obtained by dividing an inner curvature radius Rx of the effective surface of the panel following a long axis (X) by a distance Lx of the effective surface of the panel following a 1.767*long axis is Rh, a value obtained by dividing an inner curvature radius Ry of the effective surface of the panel following a short axis (Y) by a distance Ly of the effective surface following a 1.767*short axis is Rv, a value obtained by dividing an inner curvature radius of the effective surface of the panel following a diagonal axis (D) by a distance Ld of the effective surface following 1.767*diagonal axis is Ro, and the thickness of the center point of the panel is Tc.

7. The CRT of claim 6, wherein a following condition is satisfied: 9 mm≦Tc≦11.5 mm.

8. The CRT of claim 6, wherein a following condition is satisfied: $0.096*Ln(U/1\text{ mm})-0.4322 \leqq OAH/U \leqq 0.1052*Ln(U/1\text{ mm})-0.4778$, and a tube axis directional distance from the center of the outer surface of the panel to a seal edge line is OAH.

9. A color CRT having a panel of which outer surface is substantially flat and inner surface has a predetermined curvature and a funnel coupled to a rear side of the panel, wherein the center transmittance of an effective surface of the panel is 45%~75%, a diagonal size (U) of the effective surface is 650 mm~700 mm, and a following condition is satisfied:

$$-17.746*Ln(U/1\text{ mm})+116.49 \leqq (Rh*Rv*Ro)/U)*Tc \leqq -20.322*Ln(U/1\text{ mm})+133.45,$$

wherein a value obtained by dividing an inner curvature radius Rx of the effective surface of the panel following a long axis (X) by a distance Lx of the effective surface of the panel following a 1.767*long axis is Rh, a value obtained by dividing an inner curvature radius Ry of the effective surface of the panel following a short axis (Y) by a distance Ly of the effective surface following a 1.767*short axis is Rv, a value obtained by dividing an inner curvature radius of the effective surface of the panel following a diagonal axis (D) by a distance Ld of the effective surface following 1.767*diagonal axis is Ro, and the thickness of the center point of the panel is Tc.

10. The CRT of claim 9, wherein the thickness at the edge portion of the panel is equal to or smaller than 25 mm.

11. The CRT of claim 9, wherein a following condition is satisfied: 10 mm≦Tc≦13.4 mm.

* * * * *